US010911877B2

(12) United States Patent
De Vries et al.

(10) Patent No.: US 10,911,877 B2
(45) Date of Patent: Feb. 2, 2021

(54) HEARING DEVICE WITH ADAPTIVE BINAURAL AUDITORY STEERING AND RELATED METHOD

(71) Applicant: GN Hearing A/S, Ballerup (DK)

(72) Inventors: Rob De Vries, Tilburg (NL); Changxue Ma, Barrington, IL (US); Andrew Dittberner, Andover, MN (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/390,417

(22) Filed: Dec. 23, 2016

(65) Prior Publication Data

US 2018/0184214 A1 Jun. 28, 2018

(51) Int. Cl.
*H04R 25/00* (2006.01)

(52) U.S. Cl.
CPC ..... *H04R 25/407* (2013.01); *H04R 25/405* (2013.01); *H04R 25/552* (2013.01); *H04R 25/554* (2013.01); *H04R 2225/43* (2013.01); *H04R 2225/51* (2013.01); *H04R 2430/20* (2013.01); *H04S 2420/01* (2013.01)

(58) Field of Classification Search
CPC .. H04R 25/407; H04R 25/405; H04R 25/552; H04R 25/554; H04R 2225/43; H04R 2225/51; H04R 2430/23; H04R 2430/20; H04S 2420/01
USPC ..... 381/23.1, 313, 312, 92; 708/322, 300, 708/200; 455/90.3, 90.2, 88
See application file for complete search history.

(56) References Cited

U.S. PATENT DOCUMENTS 5,651,071 A * 7/1997 Lindemann ..... H04R 25/552 381/314
7,274,794 B1 * 9/2007 Rasmussen ..... H04R 3/005 381/92
2006/0177079 A1 * 8/2006 Baekgaard Jensen ..... H04R 25/40 381/312
2010/0317914 A1 * 12/2010 Puria ..... H04R 25/606 600/25
2016/0099008 A1 * 4/2016 Barker ..... H04R 25/505 704/233
2016/0112811 A1 * 4/2016 Jensen ..... H04R 5/033 381/17
2017/0295437 A1 * 10/2017 Bertelsen ..... G10L 21/0232

OTHER PUBLICATIONS

D. A. Alvarez, M. R. Zurera, R. G. Pita, Speech Enhancement Algorithms for Audiological Applications, Oct. 2013.*

* cited by examiner

*Primary Examiner* — Vivian C Chin
*Assistant Examiner* — Con P Tran
(74) *Attorney, Agent, or Firm* — Vista IP Law Group, LLP

(57) ABSTRACT

Disclosed is a hearing device and method of operating a hearing device in a binaural hearing system, the method comprising: receiving distal data from a distal hearing device; receiving an audio signal and converting the audio signal to a first microphone input signal and a second microphone input signal; and determining a beamforming scheme based on the distal data, the first microphone input signal, and the second microphone input signal, wherein determining the beamforming scheme comprises obtaining a zero-direction index, and wherein the beamforming scheme is based on the zero-direction index; and applying the beamforming scheme in a beamforming module of the hearing device.

28 Claims, 7 Drawing Sheets

Normal BASS

Optimized BASS

HEARING DEVICE WITH ADAPTIVE BINAURAL AUDITORY STEERING AND RELATED METHOD

The present disclosure relates to a hearing device with adaptive binaural auditory steering and a method of operating a hearing device in a binaural hearing system.

BACKGROUND

In acoustic environments, it is natural for a normal listener to focus on one talker while monitoring other acoustic sources. An example hereof is other talkers in a cocktail party setting or other complex acoustic environment. In this regard, the acoustic filtering due to the head shadow effect and the binaural neural interaction plays an important part to enhance the speech of the focused talker while suppressing other interference. Moreover, the brain also forms another sound image from two ears to monitor the other acoustic sources, which are suppressed by the binaural beamforming effects.

When people wear hearing aids, the signals from the acoustic sources are spatially filtered by an extra stage, i.e. hearing aids, especially when the hearing aids applies higher order beamforming technologies to enhance the directivities. Most of the time this kind of beamforming focuses only on improving the signal to noise ratio. This leads to the tunnel of directivity and the brain fails to synthesize sound images to perform the task of monitoring the surrounding acoustic events.

SUMMARY

Accordingly, there is a need for devices and methods overcoming or at least reducing the tunnel hearing effect.

Thus, a hearing device for a binaural hearing system is disclosed, the hearing device comprising a transceiver module for communication with a distal hearing device of the binaural system, the transceiver module configured for provision of distal data received from the distal hearing device; a set of microphones comprising a first microphone and a second microphone for provision of a first microphone input signal and a second microphone input signal, respectively; a beamforming module connected to the first microphone and the second microphone for processing the first microphone input signal and the second microphone input signal; a processor for processing beamformed microphone input signals and providing an electrical output signal based on an input signal from the beamforming module; a receiver for converting the electrical output signal to an audio output signal; and a beamforming controller connected to the beamforming module and the transceiver module. The beamforming controller is configured to determine a beamforming scheme, e.g. based on the distal data from the distal hearing device, the first microphone input signal, and/or the second microphone input signal. The beamforming controller may be configured to determine the beamforming scheme by obtaining a zero-direction index, wherein the beamforming scheme is based on the zero-direction index, and the beamforming controller is configured to apply the beamforming scheme in the beamforming module.

Also disclosed is a binaural hearing system comprising a first hearing device and a second hearing device, wherein the first hearing device is a hearing device as described herein, and the second hearing device is a hearing device as described herein.

Further, a method of operating a hearing device in a binaural hearing system is provided, the method comprising receiving distal data from a distal hearing device; receiving an audio signal and converting the audio signal to a first microphone input signal and a second microphone input signal; determining a beamforming scheme, e.g. based on the distal data, the first microphone input signal, and/or the second microphone input signal, wherein determining the beamforming scheme optionally comprises obtaining a zero-direction index, wherein the beamforming scheme is optionally based on the zero-direction index; and applying the beamforming scheme in a beamforming module of the hearing device.

The present devices and methods provide improved binaural auditory steering strategy (BASS) for integrating acoustic, auditory processing and selective listening mechanisms. The present devices and methods form a highly focused directional microphone beam for the attended talker and at the same time forms a receiving pattern similar to omni microphone characteristic for other talkers on the side.

The present disclosure integrates acoustical filtering, peripheral processing and central listening level to provide an improved hearing aids solution.

The present disclosure provides an optimized beamforming to accommodate both selective/targeted listening and situational awareness.

A hearing device for a binaural hearing system, includes: a transceiver module for communication with a distal hearing device of the binaural system, the transceiver module configured to receive data from the distal hearing device; a set of microphones comprising a first microphone and a second microphone for provision of a first microphone input signal and a second microphone input signal, respectively; a beamforming module connected to the first microphone and the second microphone for processing the first microphone input signal and the second microphone input signal; a processor configured to provide an electrical output signal based on an input signal from the beamforming module; a receiver for converting the electrical output signal to an audio output signal; and a beamforming controller connected to the beamforming module and the transceiver module; wherein the beamforming controller is configured to determine a beamforming scheme based on the data from the distal hearing device, the first microphone input signal, and the second microphone input signal, wherein the beamforming controller is configured to determine the beamforming scheme based on a zero-direction index, and wherein the beamforming controller is configured to apply the beamforming scheme in the beamforming module.

Optionally, the beamforming controller is configured to determine a proximal directivity pattern based on the first microphone input signal and the second microphone input signal, and wherein the transceiver is configured to transmit information regarding the proximal directivity pattern to the distal hearing device of the binaural hearing system.

Optionally, the beamforming controller is configured to determine a plurality of filter coefficient vectors, and wherein the beamforming controller is configured to apply the beamforming scheme in the beamforming module by applying the plurality of filter coefficient vectors in the beamforming module.

Optionally, the beamforming controller is configured to determine the beamforming scheme based on a first target function and a second target function, and wherein the beamforming controller is configured to determine the beamforming scheme by minimizing a cost function based on the zero-direction index, the first target function, and the second target function.

Optionally, the cost function comprises a weighted sum of error functions, wherein the error functions are based on the zero-direction index, the first target function, and the second target function, respectively.

Optionally, the beamforming controller is configured to determine the beamforming scheme by minimizing a function given as:

$$\underset{a,b,c,d}{\mathrm{ARG}\min} \int\int \begin{pmatrix} w_b * \left(BEI(f,\theta) - \min_p(\|P^l(f,\phi)\|, \|P^r(f,\phi)\|)\right)^2 + \\ w_o * \left(SAI(f,\theta) - \max_p(\|P^l(f,\phi)\|, \|P^r(f,\phi)\|)\right)^2 + \\ w_{zero} * (\|P^l(f,\phi)\| - \|P^r(f,\phi)\|)^2|_{\theta=0} \end{pmatrix} dfd\theta$$

where BEI(f,θ) is a first target function, SAI(f,θ) is a second target function, $P^l(f,\emptyset)$ is a proximal directivity pattern associated with the hearing device, and $P^r(f,\emptyset)$ is a distal directivity pattern associated with the distal hearing device, a, b, c, d are FIR filter coefficient vectors, and $w_b$, $w_o$, $w_{zero}$ are weights.

Optionally, the proximal directivity pattern is represented by $P^l(f,\emptyset)$, and wherein:

$$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is a transfer function of a first filter of the beamforming module, and $F_{fl}(f,b)$ is a transfer function of a second filter of the beamforming module.

A method of operating a hearing device in a binaural hearing system, includes: receiving data from a distal hearing device; receiving an audio signal and converting the audio signal to a first microphone input signal and a second microphone input signal; and determining a beamforming scheme based on the data, the first microphone input signal, and the second microphone input signal, wherein the beamforming scheme is based on a zero-direction index; and applying the beamforming scheme in a beamforming module of the hearing device.

Optionally, the method further includes: determining a proximal directivity pattern based on the first microphone input signal and the second microphone input signal; and transmitting information regarding the proximal directivity pattern to the distal hearing device.

Optionally, the method further includes determining a plurality of filter coefficient vectors, and wherein the beamforming scheme is applied in the beamforming module by applying the plurality of filter coefficient vectors in the beamforming module.

Optionally, the beamforming scheme is based on a first target function and a second target function, and wherein the act of determining the beamforming scheme comprises minimizing a cost function based on the zero-direction index, the first target function, and the second target function.

Optionally, the cost function comprises a weighted sum of error functions, wherein the error functions are based on the zero-direction index, the first target function, and the second target function, respectively.

Optionally, the act of determining the beamforming scheme comprises minimizing a function given as:

$$\underset{a,b,c,d}{\mathrm{ARG}\min} \int\int \begin{pmatrix} w_b * \left(BEI(f,\theta) - \min_p(\|P^l(f,\phi)\|, \|P^r(f,\phi)\|)\right)^2 + \\ w_o * \left(SAI(f,\theta) - \max_p(\|P^l(f,\phi)\|, \|P^r(f,\phi)\|)\right)^2 + \\ w_{zero} * (\|P^l(f,\phi)\| - \|P^r(f,\phi)\|)^2|_{\theta=0} \end{pmatrix} dfd\theta$$

where BEI(f,θ) is a first target function, SAI(f,θ) is a second target function, $P^l(f,\emptyset)$ is a proximal directivity pattern associated with the hearing device, and $P^r(f,\emptyset)$ is a distal directivity pattern associated with the distal hearing device, a, b, c, d are FIR filter coefficient vectors, and $w_b$, $w_o$, $w_{zero}$ are weights.

Optionally, the proximal directivity pattern is represented by $P^l(f,\emptyset)$, and wherein $$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is a transfer function of a first filter of the beamforming module, and $F_{fl}(f,b)$ is a transfer function of a second filter of the beamforming module.

A binaural hearing system comprising a first hearing device and a second hearing device, wherein one or each of the first hearing device and the second hearing device is the hearing device described herein.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
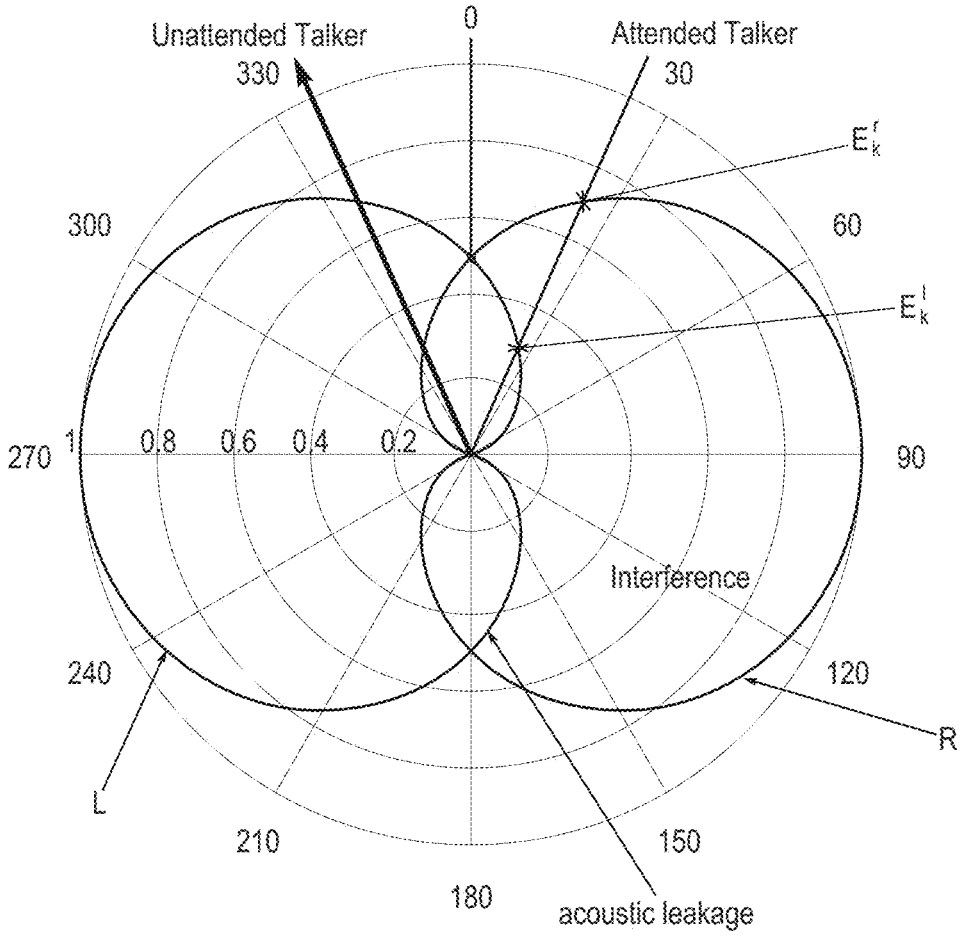
FIG. 1 illustrates directivity in an auditory system.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The binaural auditory steering strategy (BASS) is the state of art in hearing aids design to integrate acoustical filtering, peripheral processing, and central listening level to provide a hearing aids solution. BASS forms a highly focused beam for the attended talker and forms a receiving pattern similar to omni microphone characteristic for other talkers on the side such as illustrated in FIG. 1. It is to be noted that the attended talker is positioned in the zero-direction. The present disclosure facilitates design of a solution to provide streaming of acoustic signals to the auditory system, one is directional and other is similar to omni-directionality like an open ear. Thereby is intended to preserve the spatial cues in the two audio streams for spatial unmasking benefits. The present disclosure relies on the auditory system to perform processing on the incoming streams to extract the attended messages and to monitor the unattended messages.

For speech intelligibility, if the targeted source is set at zero-degree azimuth (in front), and the interference noise is coming from other directions, the auditory system would pick up a signal with best signal to noise ratio among left and right signals. On the other hand, for situational awareness, the attended message is coming from any direction and the interfering source is situated in front of the listener. The auditory system would focus on a signal with best signal to noise ratio by picking up the signal with the larger power of the two. In both cases, the signal in the front contribute the same amount of power to both ears. We can express the idea in terms of the directivity of the auditory system as seen in FIG. 1, where two cardioids illustrate the directivity patterns L and R of a left hearing aid and a right hearing aid, respectively.

The disclosed hearing devices and methods provide improved speech intelligibility and situational awareness at the same time by providing beamforming control to accommodate both human listening modes.

The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. The processor may be configured to compensate for hearing loss of a user. The hearing aid may be a binaural hearing aid.

The hearing device comprises a transceiver module for communication (receive and/or transmit) with a distal hearing device of the binaural system. The transceiver module is configured for provision of distal data received from the distal hearing device. The transceiver module may comprise an antenna for converting one or more wireless input signals from the distal hearing device to an antenna output signal. The transceiver module optionally comprises a radio transceiver coupled to the antenna for converting the antenna output signal to a transceiver input signal, e.g. including distal data. The transceiver module may comprise a plurality of antennas and/or an antenna may be configured to be operate in one or a plurality of antenna modes.

The hearing device comprises a set of microphones. The set of microphones may comprise one or more microphones. The set of microphones comprises a first microphone for provision of a first microphone input signal and/or a second microphone for provision of a second microphone input signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone input signal.

The hearing device comprises a beamforming module connected to the first microphone and the second microphone for processing the first microphone input signal and the second microphone input signal. The beamforming module operates according to a beamforming scheme. The beamforming module may comprise a first filter, such as a first FIR filter, and/or a second filter, such as a second FIR filter. The first filter processes the first microphone input signal, and the second filter processes the second microphone input signal. The filter output signals are summed to form a beamformed microphone input signal. The first FIR filter may include between 10 and 50 filter coefficients, such as in the range from 20 to 40 filter coefficients, e.g. 30 filter coefficients. The second FIR filter may include between 10 and 50 filter coefficients, such as in the range from 20 to 40 filter coefficients, e.g. 30 filter coefficients. The filter coefficients may be set or given by a filter coefficient vector, e.g. received or read from a beamforming controller, see below.

The hearing device comprises a processor for processing one or more input signals, such as beamformed microphone input signal(s). The processor provides an electrical output signal based on an input signal from the beamforming module. An input terminal of the processor is optionally connected to an output terminal of the beamforming module.

The hearing device comprises a beamforming controller connected to the beamforming module and the transceiver module. The beamformer controller is connected to the first microphone and the second microphone for receiving the first microphone input signal and the second microphone input signal. The beamforming controller is configured to determine a beamforming scheme, optionally based on the distal data from the distal hearing device, the first microphone input signal, and/or the second microphone input signal. The beamforming controller may determine the beamforming scheme by obtaining a zero-direction index. Thus, to determine the beamforming scheme may comprise to obtain a zero-direction index. The beamforming scheme may be based on the zero-direction index. The beamforming controller is configured to apply the beamforming scheme in the beamforming module.

The beamforming controller may be configured to determine a proximal directivity pattern based on the first microphone input signal and the second microphone input signal, include the proximal directivity pattern in proximal data, and transmit the proximal data to the distal hearing device of the binaural hearing system. The proximal directivity pattern is also denoted $P^l(f,\emptyset)$ and may be given as $$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is the transfer function of the first filter of the beamforming module, and $F_{fl}(f,b)$ is the transfer function of the second filter of the beamforming module.

The distal data comprises a distal directivity pattern, wherein the distal directivity pattern $P^r(f,\emptyset)$ is optionally given by $$P^r(f,\emptyset)=F_{fr}(f,d)*H_{fr}(f,\emptyset)+F_{br}(f,x)*H_{br}(f,\emptyset),$$

where $H_{br}$ is a head-related transfer function of a first microphone in the distal hearing device, $H_{fr}$ is a head-related transfer function of a second microphone in the distal hearing device, $F_{br}(f,c)$ is the transfer function of a first filter of the beamforming module in the distal hearing device, and $F_{fr}(f,d)$ is the transfer function of a second filter of the beamforming module in the distal hearing device. The distal directivity data are determined in the distal hearing device.

The beamforming controller may be configured to determine a plurality of filter coefficient vectors, such as two, three, four or more filter coefficient vectors. The beamforming controller may be configured to apply the beamforming scheme in the beamforming module by applying the plurality of filter coefficient vectors or at least some of the filter coefficient vectors in the beamforming module. The filter coefficient vectors may be FIR filter coefficient vectors, i.e. the beamforming module may comprise a FIR filter. In one or more exemplary hearing devices, the number of filter coefficient vectors determined by the beamforming controller is in the range from three to seven. A FIR filter coefficient vector may include between 10 and 50 filter coefficients, such as in the range from 20 to 40 filter coefficients, e.g. 30 filter coefficients.

The beamforming controller may be configured to determine the beamforming scheme based on a first target function and/or a second target function. The beamforming controller may be configured to determine the beamforming scheme by minimizing a cost function. In other words, the beamforming controller may be configured to solve a minimization problem, e.g. based on a cost function. The cost function may be based on the zero-direction index. The cost function may be based on the first target function. The cost function may be based on the second target function. In one or more exemplary hearing devices, the cost function is based on the zero-direction index, the first target function, and the second target function.

The cost function may be a weighted sum of error functions. The error functions may be based on the zero-direction index, the first target function, and the second target function, respectively. The cost function may be a sum or a weighted sum of at least two error functions selected from the group of a first error function based on the first target function, a second error function based on the second target function, and a third error function based on the zero-direction index.

The beamforming controller may be configured to determine the beamforming scheme by minimizing a (cost) function. The function may be given as:

$$\underset{a,b,c,d}{\mathrm{ARG}\min} \int\int \begin{pmatrix} w_b * \left(BEI(f,\theta) - \min_p(\|P^l(f,\phi)\|, \|P^r(f,\phi)\|)\right)^2 + \\ w_o * \left(SAI(f,\theta) - \max_p(\|P^l(f,\phi)\|, \|P^r(f,\phi)\|)\right)^2 + \\ w_{zero} * (\|P^l(f,\phi)\| - \|P^r(f,\phi)\|)^2|_{\theta=0} \end{pmatrix} df d\theta,$$

where BEI(f,θ) is a first target function, SAI(f,θ) is a second target function, $P^l(f,\emptyset)$ is a proximal directivity pattern of the hearing device, and $P^r(f,\emptyset)$ is a distal directivity pattern of the distal data, and $w_b$, $w_o$, $w_{zero}$ are weights. The optimization parameters a, b, c, d are FIR filter coefficient vectors. The FIR filter coefficient vector a comprises filter coefficients of first FIR filter of the beamforming module for processing the first microphone input signal. The FIR filter coefficient vector b comprises filter coefficients of second FIR filter of the beamforming module for processing the second microphone input signal. Similarly, FIR filter coefficient vectors c and d are filter coefficient vectors of the distal hearing device. The FIR filter coefficient vector c comprises filter coefficients of first FIR filter of the beamforming module of the distal hearing device for processing the first microphone input signal. The FIR filter coefficient vector d comprises filter coefficients of second FIR filter of the beamforming module of the distal hearing device for processing the second microphone input signal.

In one or more exemplary devices/methods, the weight $w_b$ is in the range from 0.1 to 3, such as in the range from 0.5 to 1.5, e.g. $w_b$=1. In one or more exemplary devices/methods, the weight $w_{zero}$ is in the range from 0.1 to 3, such as in the range from 0.5 to 1.5, e.g. $w_{zero}$=1. In one or more exemplary devices/methods, the weight $w_o$ is in the range from 0.01 to 1, such as in the range from 0.05 to 0.15, e.g. $w_o$=0.1.

The beamforming controller determines a first directivity pattern $E_k^b$ and a second directivity pattern $E_k^s$. The first directivity pattern is also denoted Better Ear Mode directivity pattern, and the second directivity pattern is also denoted Situation Awareness Mode directivity pattern.

The first directivity pattern may be given as:

$$E_k^b = \min(E_k^l, E_k^r).$$

The second directivity pattern may be given as:

$$E_k^s = \max(E_k^l, E_k^r).$$

Index k is the directional index associated with the k'th azimuth angle $\theta_k[1:n]$ and $\theta_1=0$. The superscripts r and l are related to left and right ears, where l is used for the present (proximal) hearing device described herein, and r is used for the distal hearing device. The hearing device may naturally be configured as a right ear hearing device, where the superscripts r and l are to be switched. The superscripts b and s represent better ear pattern and situational awareness pattern, respectively.

The first target function, also denoted Better Ear Index BEI(f,θ) may be given as:

$$BEI = 10 * \log 10(E_1^b / E_a^b),$$

where $$E_a^b = \frac{1}{n}\sum_{k=1}^{n} E_k^b$$

is the average power.

The second target function, also denoted Situational Awareness Index SAI(f,θ) may be given as:

$$SAI = 10 * \log 10\left(sqrt\left(\frac{1}{n}\sum_{k=1}^{n}(E_k^s - E_a^s)^2\right) \Big/ E_a^s\right),$$

where $$E_a^s = \frac{1}{n}\sum_{k=1}^{n} E_k^s$$

is the average power.

The method comprises receiving distal data from a distal hearing device. The distal data may comprise a distal directivity pattern of the distal hearing device.

The method comprises receiving an audio signal and converting the audio signal to a first microphone input signal and a second microphone input signal, e.g. with a first microphone and a second microphone, respectively, of the hearing device.

Further the method comprises determining a beamforming scheme. The beamforming scheme may be based on the distal data, the first microphone input signal, and/or the second microphone input signal. Determining the beamforming scheme optionally comprises obtaining a zero-direction index. The beamforming scheme may be based on the zero-direction index. The method comprises applying the beamforming scheme in a beamforming module of the hearing device.

The method may comprise determining a proximal directivity pattern based on the first microphone input signal and the second microphone input signal. The method may comprise including the proximal directivity pattern in proximal data; and optionally transmitting the proximal data to the distal hearing device.

The proximal directivity pattern, $P^l(f,\emptyset)$ may be given as $$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is the transfer function of the first filter of the beamforming module, and $F_{fl}(f,b)$ is the transfer function of the second filter of the beamforming module.

The method may comprise determining a plurality of filter coefficient vectors, such as FIR filter coefficient vectors. In the method, applying the beamforming scheme in the beamforming module may comprise applying the plurality of filter coefficient vectors or at least some of the filter coefficient vectors in the beamforming module.

In the method, determining the beamforming scheme may be based on a first target function and/or a second target function. Determining the beamforming scheme may comprise minimizing a cost function. In other words, determining the beamforming scheme may comprise solving a minimization problem. The cost function may be based on the zero-direction index. The cost function may be based on the first target function. The cost function may be based on the second target function. In one or more exemplary methods, the cost function is based on the zero-direction index, the first target function, and the second target function.

The cost function may be a weighted sum of error functions. The error functions may be based on the zero-direction index, the first target function, and the second target function, respectively. The cost function may be a sum or a weighted sum of at least two error functions selected from the group of or at least comprising a first error function based on the first target function, a second error function based on the second target function, and a third error function based on the zero-direction index.

In the method, determining the beamforming scheme may comprise minimizing a (cost) function. The function may be given as:

$$\underset{a,b,c,d}{\mathrm{ARG\,min}} \int\int \begin{pmatrix} w_b*\left(BEI(f,\theta)-\min_p(\|P^l(f,\phi)\|,\|P^r(f,\phi)\|)\right)^2+ \\ w_o*\left(SAI(f,\theta)-\max_p(\|P^l(f,\phi)\|,\|P^r(f,\phi)\|)\right)^2+ \\ w_{zero}*(\|P^l(f,\phi)\|-\|P^r(f,\phi)\|)^2|_{\theta=0} \end{pmatrix} df d\theta,$$

where $BEI(f,\theta)$ is a first target function, $SAI(f,\theta)$ is a second target function, $P^l(f,\emptyset)$ is a proximal directivity pattern of the hearing device, and $P^r(f,\emptyset)$ is a distal directivity pattern of the distal data, and $w_b$, $w_o$, $w_{zero}$ are weights. The optimization parameters a, b, c, d are FIR filter coefficient vectors. The FIR filter coefficient vector a comprises filter coefficients of first FIR filter of the beamforming module for processing the first microphone input signal. The FIR filter coefficient vector b comprises filter coefficients of second FIR filter of the beamforming module for processing the second microphone input signal. FIR filter coefficient vectors c and d are filter coefficients of the distal hearing device. The FIR filter coefficient vector c comprises filter coefficients of first FIR filter of the beamforming module of the distal hearing device for processing the first microphone input signal. The FIR filter coefficient vector d comprises filter coefficients of second FIR filter of the beamforming module of the distal hearing device for processing the second microphone input signal.

Figure 2:
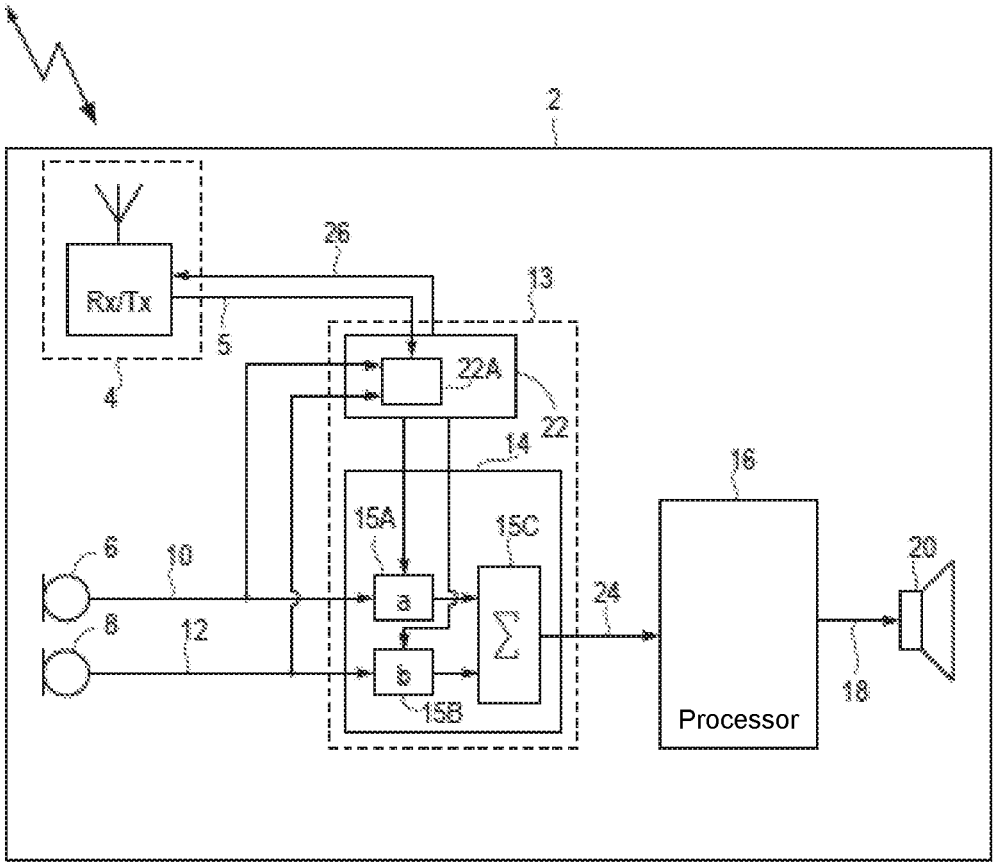
FIG. 2 schematically illustrates an exemplary hearing device.

FIG. 2 illustrates a hearing device. The hearing device 2 is configured for use in a binaural hearing system comprising a first hearing device and a second hearing device. The hearing device 2 (first/left hearing device of the binaural hearing system) comprises a transceiver module 4 for (wireless) communication with a distal/right hearing device (not shown in FIG. 2) of the binaural system. The transceiver module 4 is configured for provision of distal data 5 received from the distal hearing device. The hearing device 2 comprises a set of microphones comprising a first microphone 6 and a second microphone 8 for provision of a first microphone input signal 10 and a second microphone input signal 12, respectively. The hearing device comprises a beamformer 13 including a beamforming module 14 connected to the first microphone 6 and the second microphone 8 for receiving and processing the first microphone input signal 10 and the second microphone input signal 12. The beamforming module comprises a first filter 15A and a second filter 15B. The first filter 15A processes the first microphone input signal 10 and the second filter 15B processes the second microphone input signal 12. The processed microphone input signals are summed in adder 15C to form beamformed microphone input signal 24. The first filter 15A has a transfer function denoted $F_{bl}(f,a)$, and the second filter 15B has a transfer function denoted $F_{fl}(f,b)$. In the illustrated implementation, the first filter 15A and the second filter 15B each has 30 filter coefficients.

Further, the hearing device 2 comprises a processor 16 for processing the beamformed microphone input signal 24 and providing an electrical output signal 18 based on an input signal from the beamforming module. The hearing device 2 comprises a receiver 20 for converting the electrical output signal to an audio output signal, and a beamforming controller 22 forming part of beamformer 13 and connected to the beamforming module 14 and the transceiver module 4. The transceiver unit 4 transmits distal data 5 to the beamforming controller and the beamforming controller 22 is connected to the first microphone 6 and the second microphone 8 for receiving microphone input signals 10, 12.

The beamforming controller 22 is configured to determine, e.g. with determiner 22A, a beamforming scheme based on the distal data from the distal hearing device, the first microphone input signal, and the second microphone input signal. The beamforming scheme comprises four FIR filter coefficient vectors a, b, c, and d and the beamforming controller 22 is configured to determine the filter coefficient vectors a, b, c, d by minimizing a function given as:

$$\underset{a,b,c,d}{\mathrm{ARG\,min}} \int\int \begin{pmatrix} w_b*\left(BEI(f,\theta)-\min_p(\|P^l(f,\phi)\|,\|P^r(f,\phi)\|)\right)^2+ \\ w_o*\left(SAI(f,\theta)-\max_p(\|P^l(f,\phi)\|,\|P^r(f,\phi)\|)\right)^2+ \\ w_{zero}*(\|P^l(f,\phi)\|-\|P^r(f,\phi)\|)^2|_{\theta=0} \end{pmatrix} df d\theta,$$

where $BEI(f,\theta)$ is a first target function, $SAI(f,\theta)$ is a second target function, $P^l(f,\emptyset)$ is a proximal directivity pattern of the hearing device, and $P^r(f,\emptyset)$ is a distal directivity pattern of the distal data, $(\|P^l(f,\emptyset)\|-\|P^r(f,\emptyset)\|)^2$ is the zero-direction index, and $w_b$, $w_o$, $w_{zero}$ are weights. The optimization parameters a, b, c, d are FIR filter coefficient vectors. The FIR filter coefficient vector a comprises filter coefficients of first FIR filter 15A of the beamforming module for processing the first microphone input signal 10. The FIR filter coefficient vector b comprises filter coefficients of second FIR filter 15B of the beamforming module for processing the second microphone input signal 12. FIR filter coefficient vectors c and d are filter coefficients of the distal hearing device. The FIR filter coefficient vector c comprises filter coefficients of first FIR filter of the beamforming module of the distal hearing device for processing the first microphone input signal. The FIR filter coefficient vector d comprises filter coefficients of second FIR filter of the beamforming module of the distal hearing device for processing the second microphone input signal.

The proximal directivity pattern, $P^l(f,\emptyset)$ is given as $$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is the transfer function of the first filter of the beamforming module, and $F_{fl}(f,b)$ is the transfer function of the second filter of the beamforming module.

The beamforming controller 22 applies the beamforming scheme in the beamforming module by applying the filter coefficient vectors a and b in the beamforming module by transmitting the filter coefficient vectors a and b to the beamforming module.

Further, the beamforming controller 22 is configured to determine a proximal directivity pattern based on the first microphone input signal and the second microphone input signal, include the proximal directivity pattern in proximal data, and transmit the proximal data 26 to the distal hearing device of the binaural hearing system via the transceiver unit 4. Thereby the distal hearing device can optimize the beamforming scheme of the distal hearing device such that the hearing devices in the binaural hearing system cooperate in forming an optimum beamforming in the binaural hearing system.

Figure 3:
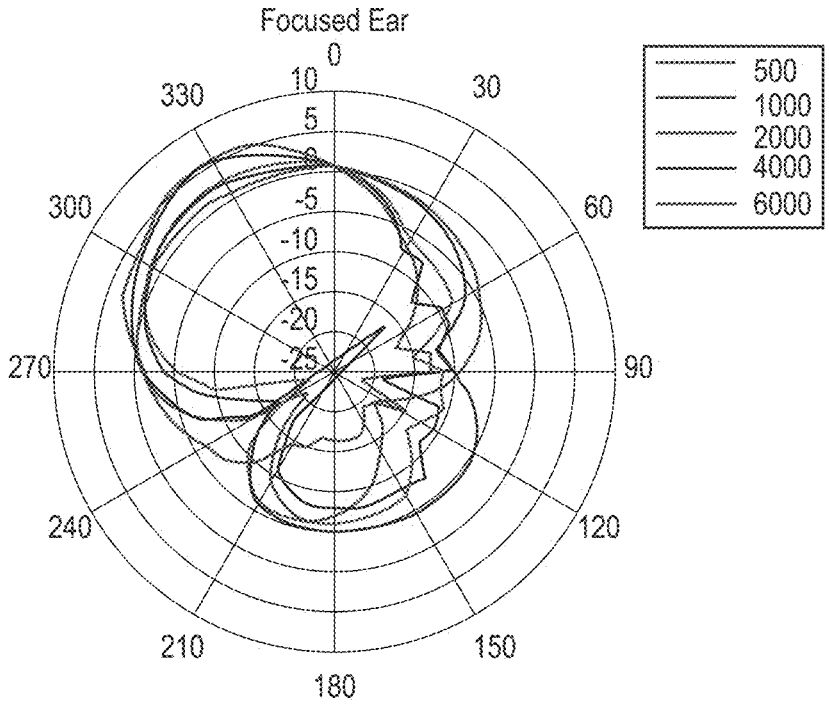
FIG. 3 show directivity patterns for two hearing devices.
Figure 3:
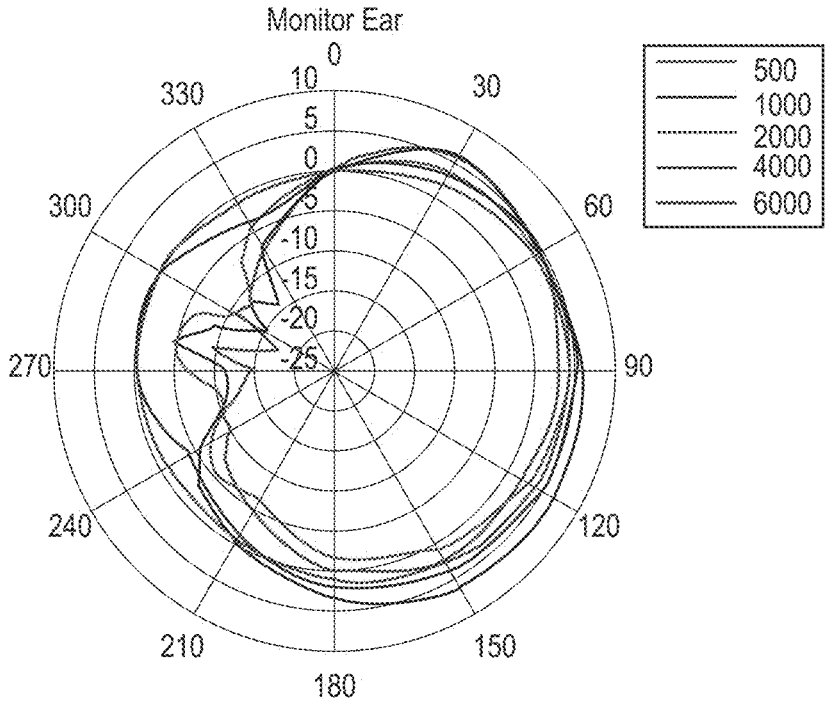
Figure 4:
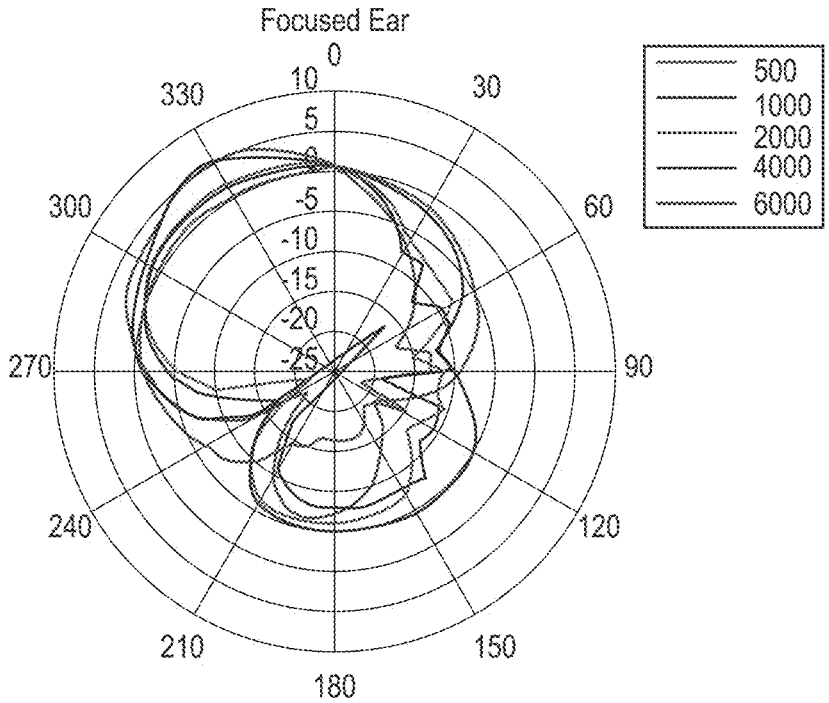
FIG. 4 show optimized directivity patterns for two hearing devices.
Figure 4:
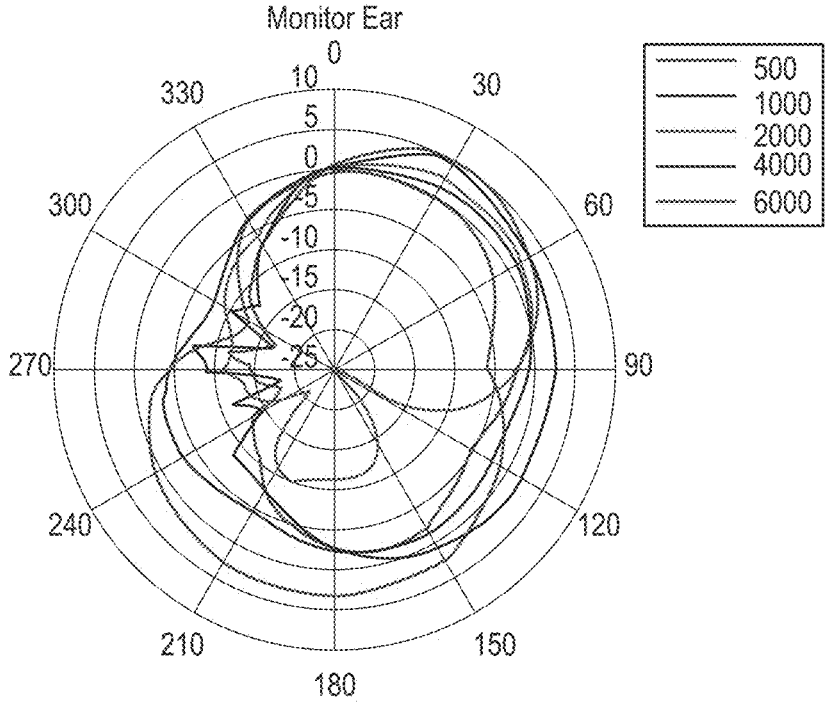

FIG. 3 shows BASS directivity patterns for two hearing devices and FIG. 4 shows optimized BASS directivity patterns for two hearing devices. It is to be noted that in particular the directivity patterns at lower frequencies (500 and 1,000 Hz) of the monitor ear are changed in the optimized BASS beamforming scheme in FIG. 4.

Figure 5:
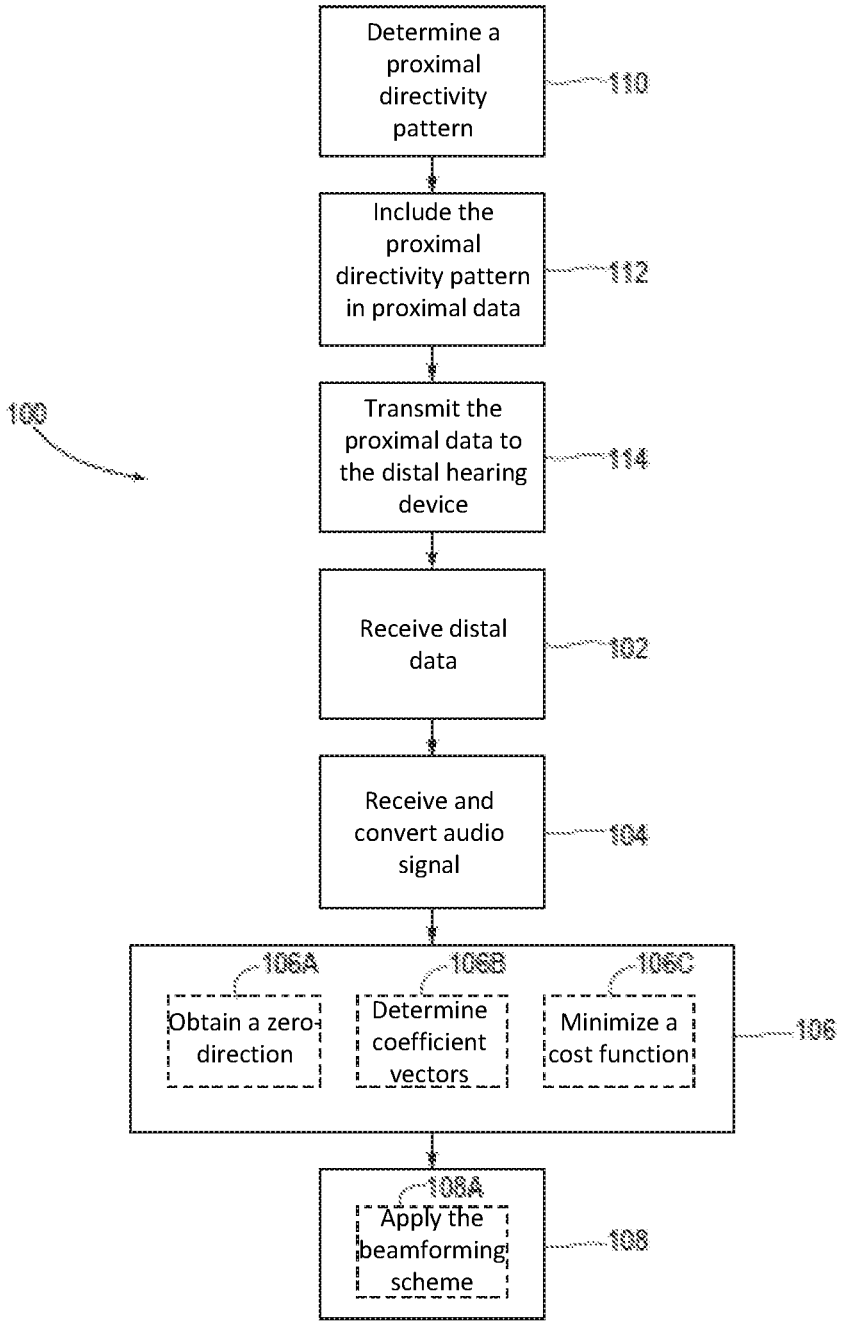
FIG. 5 is a flow diagram of an exemplary method.

FIG. 5 shows a flow chart of an exemplary method operating a hearing device, such as hearing device 2, in a binaural hearing system. The method 100 comprises receiving 102 distal data from a distal hearing device, e.g. via transceiver module 4, the distal data comprising a distal directivity pattern. Further, method 100 comprises receiving 104 an audio signal and converting the audio signal to a first microphone input signal and a second microphone input signal, e.g. with first microphone 6 and second microphone 8; The method 100 proceeds to determining 106 a beamforming scheme based on the distal data, the first microphone input signal, and the second microphone input signal, e.g. with beamforming controller 22. Determining 106 the beamforming scheme comprises obtaining 106A a zero-direction index, and the beamforming scheme is optionally based on the zero-direction index. The method 100 comprises applying 108 the beamforming scheme in a beamforming module, such as beamforming module 14, of the hearing device. The method 100 comprises determining 110 a proximal directivity pattern based on the first microphone input signal and the second microphone input signal, including 112 the proximal directivity pattern in proximal data; and transmitting 114 the proximal data to the distal hearing device, e.g. via transceiver module 4.

The method 100 comprises, as part of determining 106 a beamforming scheme, determining 106B a plurality of filter coefficient vectors, and wherein applying 108 the beamforming scheme in the beamforming module comprises applying 108A the plurality of filter coefficient vectors in the beamforming module. Determining 106 the beamforming scheme is based on a first target function and a second target function, and determining 106 the beamforming scheme comprises minimizing 106C a cost function based on the zero-direction index, the first target function, and the second target function. In the illustrated method 100, the cost function is a weighted sum of error functions, wherein the error functions are based on the zero-direction index, the first target function, and the second target function, respectively. Further, determining 106 the beamforming scheme comprises minimizing, e.g. as part of 106C, a function given as:

$$\underset{a,b,c,d}{\mathrm{ARG\,min}} \int\int \begin{pmatrix} w_b*\left(BEI(f,\theta)-\min_p(\|P^l(f,\emptyset)\|,\|P^r(f,\emptyset)\|)\right)^2+ \\ w_o*\left(SAI(f,\theta)-\max_p(\|P^l(f,\emptyset)\|,\|P^r(f,\emptyset)\|)\right)^2+ \\ w_{zero}*(\|P^l(f,\emptyset)\|-\|P^r(f,\emptyset)\|)^2|_{\theta=0} \end{pmatrix} df d\theta$$

where $BEI(f,\theta)$ is a first target function, $SAI(f,\theta)$ is a second target function, $P^l(f,\emptyset)$ is a proximal directivity pattern of the hearing device, and $P^r(f,\emptyset)$ is a distal directivity pattern of the distal data, a, b, c, d are FIR filter coefficient vectors of beamforming modules of the hearing device and the distal hearing device, and $w_b$, $w_o$, $w_{zero}$ are weights. The optimization parameters are the filter coefficient vectors a, b, c, d. The filter coefficient vectors may each include between 10 and 50 filter coefficients, such as in the range from 20 to 40 filter coefficients, e.g. 30 filter coefficients. The proximal directivity pattern, $P^l(f,\emptyset)$ is given as $$P^l(f,\emptyset)=F_{fl}(f,b)*H_{fl}(f,\emptyset)+F_{bl}(f,a)*H_{bl}(f,\emptyset),$$

where $H_{bl}$ is a head-related transfer function of the first microphone, $H_{fl}$ is a head-related transfer function of the second microphone, $F_{bl}(f,a)$ is the transfer function of a first filter of the beamforming module, and $F_{fl}(f,b)$ is the transfer function of a second filter of the beamforming module.

Figure 6:
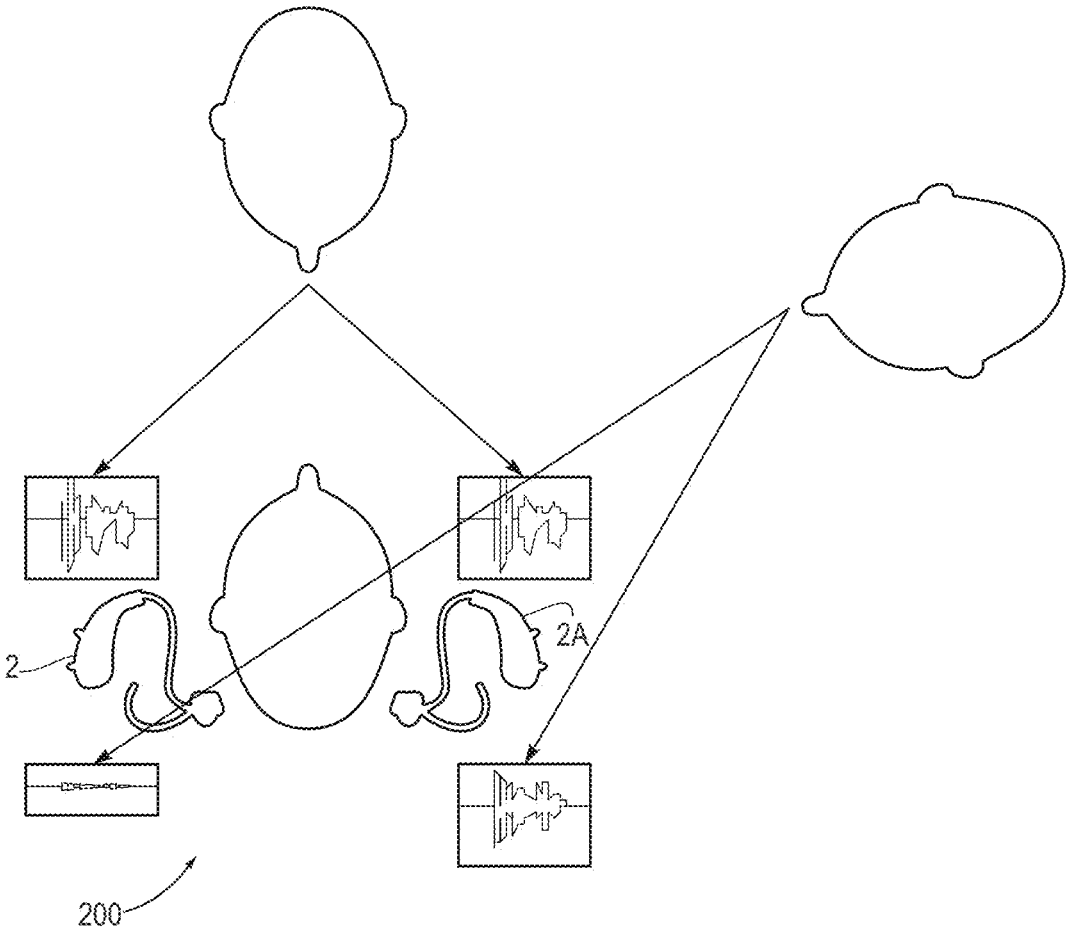
FIG. 6 shows a binaural hearing system.
Figure 7:
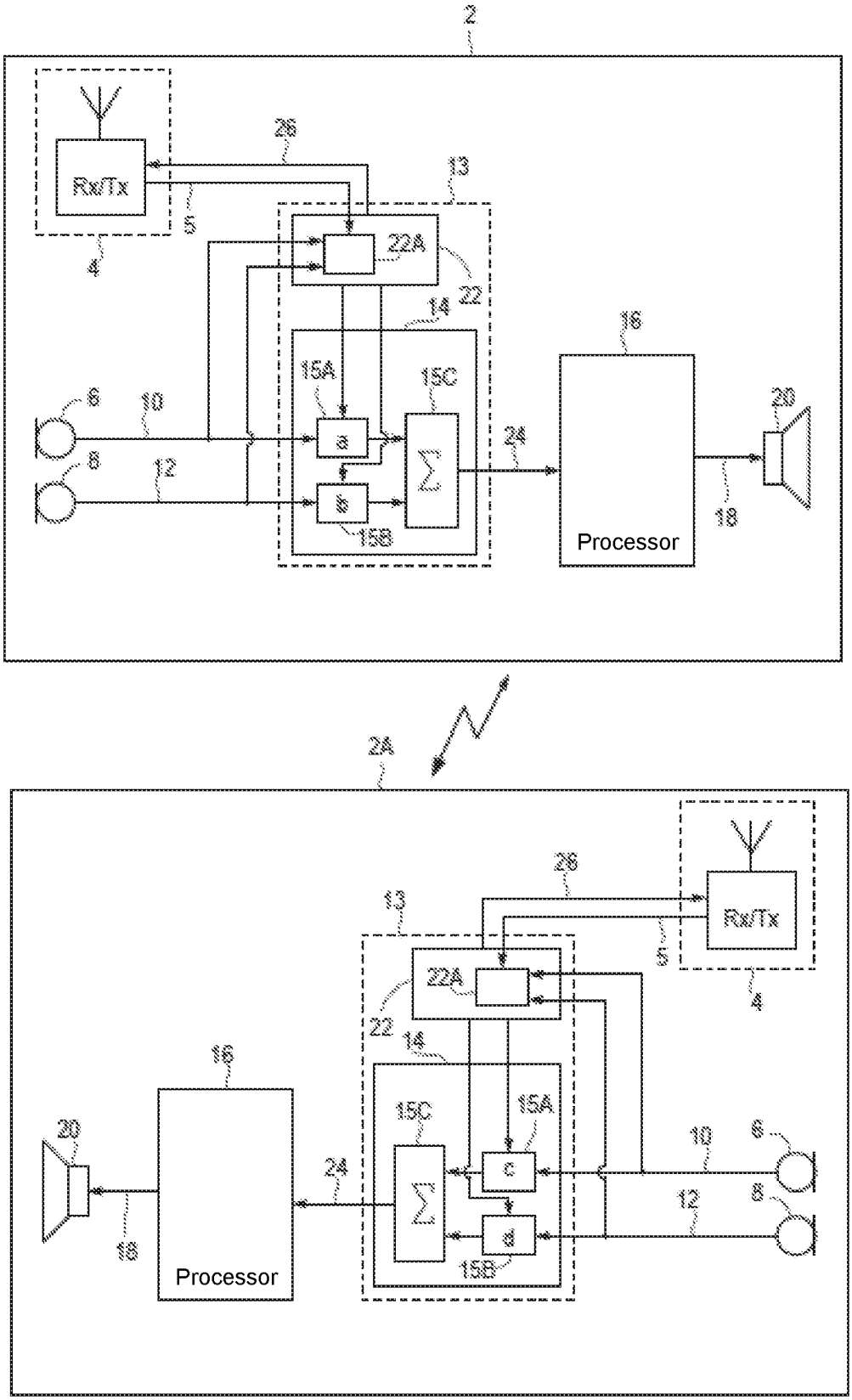
FIG. 7 schematically illustrates an exemplary hearing device.

FIG. 6 shows a binaural hearing system 200 comprising a first hearing device 2 and a second hearing device 2A, with the difference that first and second filters of hearing device 2A use the filter coefficient vectors c and d instead of filter coefficient vectors a and b as in hearing device 2, and the hearing aid 2A receives $P^l(f,\emptyset)$ as part of distal data 5 and transmits $P^r(f,\emptyset)$ as part of proximal data 26, see FIG. 7.

FIG. 7 shows an exemplary hearing device 2A being a second hearing device of binaural hearing system 200. The beamforming controller 22 of hearing device 2A transmits filter coefficient vectors c and d to the first filter 15A and the second filter 15B, respectively, of the hearing device.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2, 2A hearing device
4 transceiver module
5 distal data
6 first microphone
8 second microphone
10 first microphone input signal
12 second microphone input signal
13 beamformer
14 beamforming module
15A first filter
15B second filter
15C adder
16 processor
18 electrical output signal
20 receiver
22 beamforming controller
22A determiner
24 beamformed microphone input signal
26 proximal data
100 method of operating a hearing device
102 receiving distal data
104 receiving and converting audio signal
106 determining a beamforming scheme
106A obtaining a zero-direction index
106B determining a plurality of filter coefficient vectors
106C minimizing a cost function
108 applying the beamforming scheme
108A applying the plurality of filter coefficient vectors
110 determining a proximal directivity pattern
112 including the proximal directivity pattern in proximal data
114 transmitting the proximal data to the distal hearing device
200 binaural hearing system

The invention claimed is:

1. A hearing device for a binaural hearing system, the hearing device comprising:

a transceiver module for communication with a distal hearing device of the binaural system, the transceiver module configured to receive data from the distal hearing device, the data comprising directivity information;

a set of microphones comprising a first microphone and a second microphone for provision of a first microphone input signal and a second microphone input signal, respectively;

a beamforming module connected to the first microphone and the second microphone for processing the first microphone input signal and the second microphone input signal;

a processor configured to provide an electrical output signal based on an input signal from the beamforming module;

a receiver configured to provide an audio output signal; and a beamforming controller connected to the beamforming module and the transceiver module, wherein the beamforming controller is configured to determine a beamforming scheme based on the directivity information from the distal hearing device, the first microphone input signal, and the second microphone input signal, and wherein the beamforming controller is configured to apply the beamforming scheme determined based on the directivity information from the distal hearing device to at least reduce a tunnel-of-directivity effect associated with a directionality for the audio output signal while the directionality is maintained.

2. The hearing device according to claim 1, wherein the beamforming controller is configured to determine a proximal directivity pattern based on the first microphone input signal and the second microphone input signal, and wherein the transceiver is configured to transmit information regarding the proximal directivity pattern to the distal hearing device of the binaural hearing system.

3. The hearing device according to claim 2, wherein the proximal directivity pattern is represented by $P^l/(f, \theta)$, and wherein:

$$P^l(f,\theta)=F_{fl}(f,b)*H_{fl}(f,\theta)+F_{bl}(f,a)*H_{bl}(f,\theta)$$

where $H_{bl}$ is a head-related transfer function of the first microphone, $H_{fl}$ is a head-related transfer function of the second microphone, $F_{bl}(f,a)$ is a transfer function of a first filter of the beamforming module, and $F_{fl}(f,b)$ is a transfer function of a second filter of the beamforming module.

4. The hearing device according to claim 1, wherein the beamforming controller is configured to determine a plurality of filter coefficient vectors, and wherein the beamforming controller is configured to apply the beamforming scheme in the beamforming module by applying the plurality of filter coefficient vectors in the beamforming module.

5. The hearing device according to claim 1, wherein the beamforming controller is configured to determine the beamforming scheme based on a first target function and a second target function, and wherein the beamforming controller is configured to determine the beamforming scheme by minimizing a cost function based on a zero-direction index, the first target function, and the second target function.

6. The hearing device according to claim 5, wherein the cost function comprises a weighted sum of error functions, wherein the error functions are based on a zero-direction index, the first target function, and the second target function, respectively.

7. The hearing device according to claim 1, wherein the beamforming controller is configured to determine the beamforming scheme based on a zero-direction index.

8. The hearing device according to claim 7, wherein the zero-direction index is based at least in part on a first directivity pattern associated with the hearing device and a second directivity pattern associated with the distal hearing device.

9. The method according to claim 1, wherein the directivity information indicates a directivity pattern.

10. A hearing device for a binaural hearing system, the hearing device comprising:

a transceiver module for communication with a distal hearing device of the binaural system, the transceiver module configured to receive data from the distal hearing device;

a set of microphones comprising a first microphone and a second microphone for provision of a first microphone input signal and a second microphone input signal, respectively;

a beamforming module connected to the first microphone and the second microphone for processing the first microphone input signal and the second microphone input signal;

a processor configured to provide an electrical output signal based on an input signal from the beamforming module;

a receiver for converting the electrical output signal to an audio output signal; and a beamforming controller connected to the beamforming module and the transceiver module, wherein the beamforming controller is configured to determine a beamforming scheme based on the data from the distal hearing device, the first microphone input signal, and the second microphone input signal, and wherein the beamforming controller is configured to apply the beamforming scheme in the beamforming module; and wherein the beamforming controller is configured to determine the beamforming scheme by minimizing a function given as:

$$\underset{a,b,c,d}{\mathrm{ARG}\min}\int\int\begin{pmatrix} w_b*\left(BEI(f,\theta)-\min_p(\|P^l(f,\phi)\|,\|P^r(f,\phi)\|)\right)^2+ \\ w_o*\left(SAI(f,\theta)-\max_p(\|P^l(f,\phi)\|,\|P^r(f,\phi)\|)\right)^2+ \\ w_{zero}*(\|P^l(f,\phi)\|-\|P^r(f,\phi)\|)^2|_{\theta=0} \end{pmatrix}dfd\theta$$

where BEI(f, θ) is a first target function, SAI(f, θ) is a second target function, $P^l$/(f, θ) is a proximal directivity pattern associated with the hearing device, and $P^r$ (f, θ) is a distal directivity pattern associated with the distal hearing device, a, b, c, d are FIR filter coefficient vectors, and $w_b$, $w_o$, $w_{zero}$ are weights.

11. The hearing device according to claim 10, wherein the beamforming controller is configured to determine the beamforming scheme based on a zero-direction index.

12. A method of operating a hearing device in a binaural hearing system, the method comprising:

receiving data from a distal hearing device, the data comprising directivity information;

receiving an audio signal and converting the audio signal to a first microphone input signal and a second microphone input signal; and determining a beamforming scheme based on the directivity information, the first microphone input signal, and the second microphone input signal; and applying the beamforming scheme determined based on the directivity information from the distal hearing device in a beamforming module of the hearing device to at least reduce a tunnel-of-directivity effect associated with a directionality for an audio output signal while the directionality is maintained.

13. The method according to claim 12, further comprising:

determining a proximal directivity pattern based on the first microphone input signal and the second microphone input signal; and transmitting information regarding the proximal directivity pattern to the distal hearing device.

14. The method according to claim 13, wherein the proximal directivity pattern is represented by $P^1(f,\theta)$, and wherein $$P^1(f,\theta)=F_{fl}(f,b)*H_{fl}(f,\theta)+F_{bl}(f,a)*H_{bl}(f,\theta),$$

where $H_{bl}$ is a head-related transfer function of the first microphone, $H_{fl}$ is a head-related transfer function of the second microphone, $F_{bl}$(f,a) is a transfer function of a first filter of the beamforming module, and $F_{fl}$(f,b) is a transfer function of a second filter of the beamforming module.

15. The method according to claim 12, further comprising determining a plurality of filter coefficient vectors, and wherein the beamforming scheme is applied in the beamforming module by applying the plurality of filter coefficient vectors in the beamforming module.

16. The method according to claim 12, wherein the beamforming scheme is based on a first target function and a second target function, and wherein the act of determining the beamforming scheme comprises minimizing a cost function based on a zero-direction index, the first target function, and the second target function.

17. The method according to claim 16, wherein the cost function comprises a weighted sum of error functions, wherein the error functions are based on a zero-direction index, the first target function, and the second target function, respectively.

18. The method according to claim 12, wherein the directivity information indicates a directivity pattern.

19. The method according to claim 18, wherein the zero-direction index is based at least in part on a first directivity pattern associated with the hearing device and a second directivity pattern associated with the distal hearing device.

20. A method of operating a hearing device in a binaural hearing system, the method comprising:

receiving data from a distal hearing device;

receiving an audio signal and converting the audio signal to a first microphone input signal and a second microphone input signal; and determining a beamforming scheme based on the data, the first microphone input signal, and the second microphone input signal; and applying the beamforming scheme in a beamforming module of the hearing device;

wherein the act of determining the beamforming scheme comprises minimizing a function given as:

$$\underset{a,b,c,d}{\mathrm{ARG}\min}\int\int\begin{pmatrix} w_b*\left(BEI(f,\theta)-\min_p(\|P^l(f,\phi)\|,\|P^r(f,\phi)\|)\right)^2+ \\ w_o*\left(SAI(f,\theta)-\max_p(\|P^l(f,\phi)\|,\|P^r(f,\phi)\|)\right)^2+ \\ w_{zero}*(\|P^l(f,\phi)\|-\|P^r(f,\phi)\|)^2|_{\theta=0} \end{pmatrix}dfd\theta$$

where BEI(f,θ) is a first target function, SAI(f,θ) is a second target function, $P^1$(f,θ) is a proximal directivity pattern associated with the hearing device, and $P^r$(f,θ) is a distal directivity pattern associated with the distal hearing device, a, b, c, d are FIR filter coefficient vectors, and $w_b$, $w_o$, $w_{zero}$ are weights.

21. A binaural hearing system comprising a first hearing device and a second hearing device, wherein one or each of the first hearing device and the second hearing device is the hearing device according to claim 1.

22. A hearing device for a binaural hearing system, the hearing device comprising:

a transceiver module for communication with a distal hearing device of the binaural system, the transceiver module configured to receive data from the distal hearing device, the data comprising directivity information;

a set of microphones comprising a first microphone and a second microphone for provision of a first microphone input signal and a second microphone input signal, respectively;

a beamforming module connected to the first microphone and the second microphone for processing the first microphone input signal and the second microphone input signal;

a processor configured to provide an electrical output signal based on an input signal from the beamforming module;

a receiver configured to provide an audio output signal; and a beamforming controller connected to the beamforming module and the transceiver module, wherein the beamforming controller is configured to determine a beamforming scheme based on the directivity information from the distal hearing device, the first microphone input signal, and the second microphone input signal, wherein the beamforming module is configured to perform beamforming based on the directivity information from the distal hearing device to at least reduce a tunnel-of-directivity effect associated with a directionality for the audio output signal while the directionality is maintained.

23. A hearing device for a binaural hearing system, the hearing device comprising:

a transceiver module for communication with a distal hearing device of the binaural system, the transceiver module configured to receive data from the distal hearing device, the data comprising directivity information;

a set of microphones comprising a first microphone and a second microphone for provision of a first microphone input signal and a second microphone input signal, respectively;

a beamforming module connected to the first microphone and the second microphone for processing the first microphone input signal and the second microphone input signal;

a processor configured to provide an electrical output signal based on an input signal from the beamforming module;

a receiver configured to provide an audio output signal; and a beamforming controller connected to the beamforming module and the transceiver module, wherein the beamforming controller is configured to determine a beamforming scheme based on the directivity information from the distal hearing device, the first microphone input signal, and the second microphone input signal, wherein the beamforming controller is configured to determine the beamforming scheme based on a forward facing direction of a user of the hearing device, and wherein the beamforming controller is configured to apply the beamforming scheme determined based on the directivity information from the distal hearing device to at least reduce a tunnel-of-directivity effect associated with a directionality for the audio output signal while the directionality is maintained.

24. The hearing device according to claim 23, wherein the forward facing direction of the user corresponds with a zero-degree azimuth.

25. A binaural hearing system comprising a first hearing device and a second hearing device, the first hearing device comprising:

a transceiver module for communication with the second hearing device of the binaural system, the transceiver module configured to receive data from the second hearing device, the data comprising directivity information;

a set of microphones comprising a first microphone and a second microphone for provision of a first microphone input signal and a second microphone input signal, respectively;

a beamforming module connected to the first microphone and the second microphone for processing the first microphone input signal and the second microphone input signal;

a processor configured to provide an electrical output signal based on an input signal from the beamforming module; and a receiver configured to provide an audio output signal;

wherein the binaural hearing system is configured to simultaneously provide both a first acoustic signal and a second acoustic signal to a user of the binaural hearing system, wherein the first acoustic signal is directional, and the second acoustic signal has an omni-directional characteristic; and wherein the beamforming module is configured to perform beamforming based on the directivity information received from the second hearing device to reduce a tunnel-of-directivity effect associated with a directionality for the audio output signal while the directionality is maintained.

26. The binaural hearing system according to claim 25, wherein the first acoustic signal corresponds with a sound source that is of interest to the user of the binaural hearing system.

27. The binaural hearing system according to claim 25, wherein the second acoustic signal is configured to allow the user of the binaural hearing system to monitor unattended sound.

28. The binaural hearing system according to claim 25, wherein the first acoustic signal is associated with the first hearing device, and the second acoustic signal is associated with the second hearing device.

* * * * *